US005173976A

United States Patent [19]

Jubinville

[11] Patent Number: 5,173,976

[45] Date of Patent: Dec. 29, 1992

[54] MATTRESS COVER/FITTED BED SHEET

[75] Inventor: Gisele B. Jubinville, St. Albert, Canada

[73] Assignee: Enerbase Foundations Ltd., St. Albert, Canada

[21] Appl. No.: 872,759

[22] Filed: Apr. 23, 1992

Related U.S. Application Data

[63] Continuation-in-part of Ser. No. 588,357, Sep. 26, 1990, abandoned.

[30] Foreign Application Priority Data

Sep. 29, 1989 [CA] Canada ..... 614779

[51] Int. Cl.[5] ..... A47G 9/02

[52] U.S. Cl. ..... 5/497; 5/499

[58] Field of Search ..... 5/494–499

[56] References Cited

U.S. PATENT DOCUMENTS

| | | | |
|---|---|---|---|
| 2,787,794 | 4/1957 | Hughes et al. | 5/335 |
| 2,788,532 | 4/1957 | Christley | 5/497 |
| 3,148,388 | 9/1964 | Espersen | 5/334 |
| 3,273,175 | 9/1966 | Anderson et al. | 5/334 |
| 3,413,665 | 12/1968 | Amet | 5/334 |
| 3,438,068 | 4/1969 | Anderson et al. | 5/497 |
| 3,694,832 | 10/1972 | Jamison | 5/497 |
| 3,962,739 | 6/1976 | Crockett | 5/334 C |
| 4,145,778 | 3/1979 | Ferrante et al. | 5/334 R |
| 4,192,032 | 3/1980 | Geraci | 5/497 |
| 4,237,805 | 12/1980 | Ferrante et al. | 112/262.1 |
| 4,245,365 | 1/1981 | Large | 5/497 |
| 4,308,626 | 1/1982 | Weiss | 5/485 |
| 4,334,196 | 8/1982 | Large | 5/496 |
| 4,338,693 | 7/1982 | Vitale | 5/500 |
| 4,698,865 | 10/1987 | Walker | 5/495 X |
| 4,723,330 | 2/1988 | Kellogg et al. | 5/497 |
| 4,727,608 | 3/1988 | Joyce | 5/497 |
| 4,912,790 | 4/1990 | MacDonald | 5/497 |

*Primary Examiner*—Michael F. Trettel
*Attorney, Agent, or Firm*—Beveridge, DeGrandi & Weilacher

[57] ABSTRACT

A mattress cover/fitted bed sheet which consists of a substantially rectangular blank of textile material with opposed sides and opposed ends. A pair of generally triangular pieces are cut out of the opposed sides adjacent the ends. Each of the triangular cut outs has a pair of opposed sides, an apex directed inwardly on the textile material and a base coincident with one of the sides of the textile material. The sides of the triangular cut outs are joined to form a biased side seam such that, when placed on a mattress, textile material is drawn under the end of the mattress.

8 Claims, 2 Drawing Sheets

FIG. 1-A
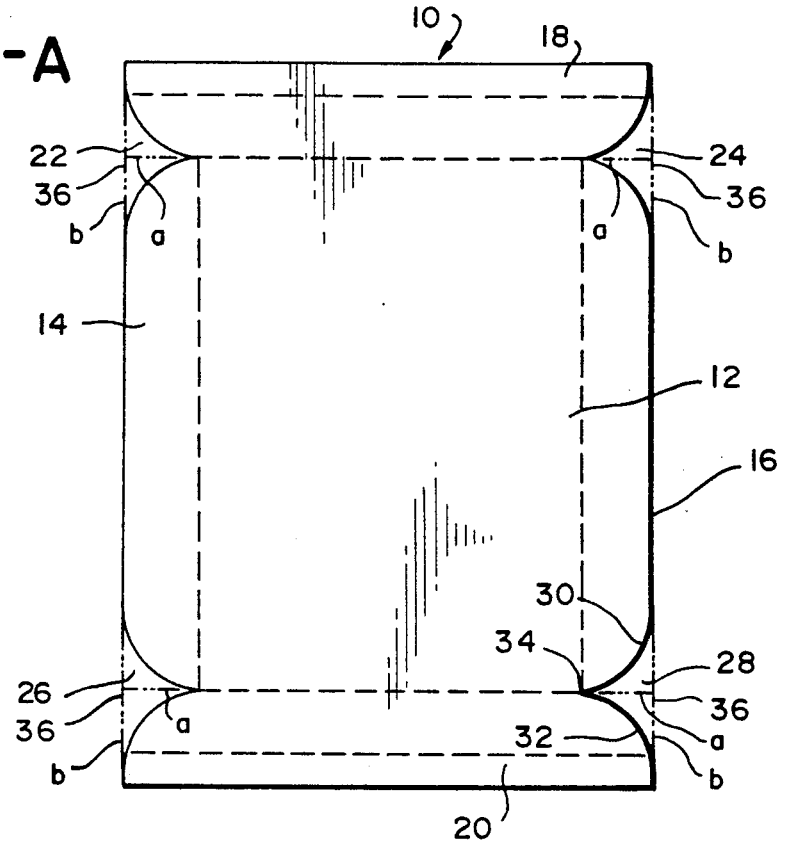
FIG. 1-B
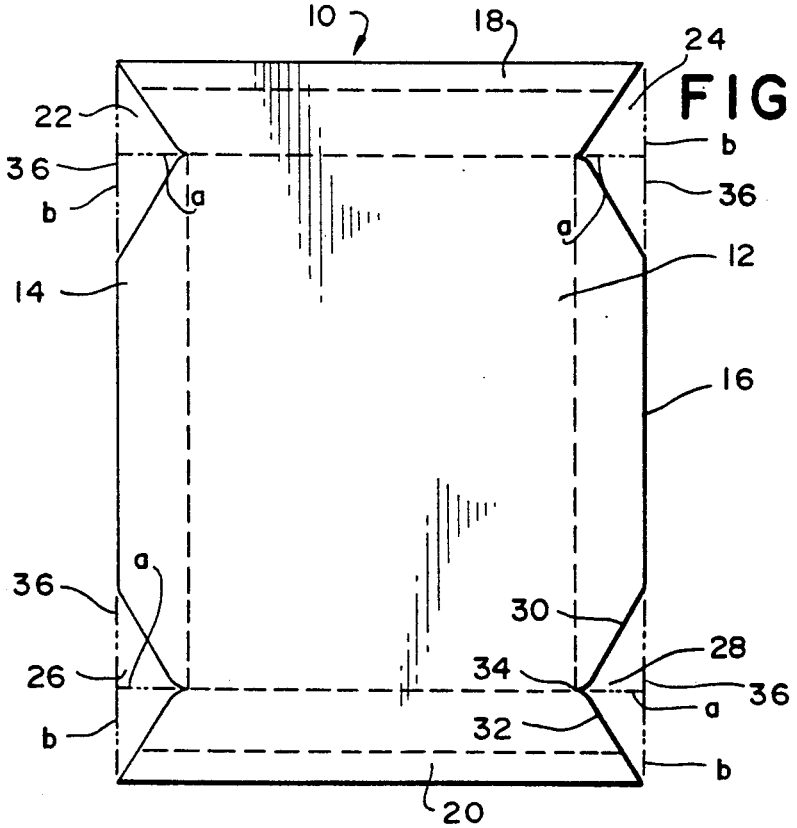

MATTRESS COVER/FITTED BED SHEET

This application is a continuation-in-part of allowed patent application Ser. No. 07/588,357, filed Sep. 26, 1990, now abandoned, which is incorporated herein by reference.

The present invention relates to a mattress cover/fitted bed sheet.

BACKGROUND OF THE INVENTION

The weight of an occupant of a bed exerts tension in a longitudinal direction upon that portion of a fitted bed sheet or mattress cover engaging the ends of the bed. The ends of existing fitted bed sheets, usually at one of the corners, tend to ride up and eventually slide right off the ends of the mattress.

Attempts have been made to address this problem by having mattress cover or fitted bed sheets designs which permit material to be placed under the mattress. These designs have reduced the problem but have not been effective in eliminating it. The weakness of the existing designs become apparent when one attempts to increase the amount of material underlying the end of the mattress. In some designs the material at the ends must equal the material at the sides, this makes it difficult to place the mattress cover or fitted sheet on the mattress when the material at the ends is increased. In other designs the ends become exceedingly loose as the amount of material at the ends is increased; the designs are not functional unless an extra seam is added which limits them to one particular thickness of mattress.

SUMMARY OF THE INVENTION

What is required is an alternative fitted bed sheet or mattress cover which will fit a variety of thicknesses of mattresses by drawing material under and gripping the end of the mattress.

Broadly, the present invention provides a mattress cover/fitted bed sheet which is comprised of a substantially rectangular blank of textile material with opposed sides and opposed ends. A pair of triangular pieces are cut out of the opposed sides adjacent at least one of the ends. Each of the triangular cut outs has a pair of opposed sides, an apex directed inwardly on the textile material and a base coincident with one of the sides of the textile material. The sides of the triangular cut outs are joined to form a biased side seam such that, when placed on a mattress, textile material is drawn under the end of the mattress.

The fitted bed sheet as described draws material under and grips one end of a mattress. This enables a person to slip under the sheet. Where it is desired that the mattress cover/fitted bed sheet grip the mattress at both ends biased side seams are placed along triangular cuts outs adjacent each end. Although the sides of the triangular cut out need not be equal, the Applicant prefers that they be equal as this gives the mattress cover/fitted bed sheet a neater appearance.

Although beneficial results may be obtained through the use of the mattress cover/fitted bed sheet as described a superior fit at the corners may be obtained by providing the sides of the triangular cut out with arcuate end portions such that when joined to form the biased side seam a contoured corner is created. A similar effect can be created by having the side of the triangle curvilinear.

BRIEF DESCRIPTION OF THE DRAWINGS

These and other features of the invention will become more apparent from the following description in which reference is made to the appended drawings, wherein:

FIG. 1-A is a top plan view of a flat, substantially rectangular blank of textile material from which the mattress cover/fitted bed sheet is formed, with one type of triangular cutout.

FIG. 1-B is a top plan view of a flat, substantially rectangular blank of textile material from which the mattress cover/fitted bed sheet is formed, with an alternate form of triangular cut out.

DETAILED DESCRIPTION OF THE PREFERRED EMBODIMENT

Figure 2:
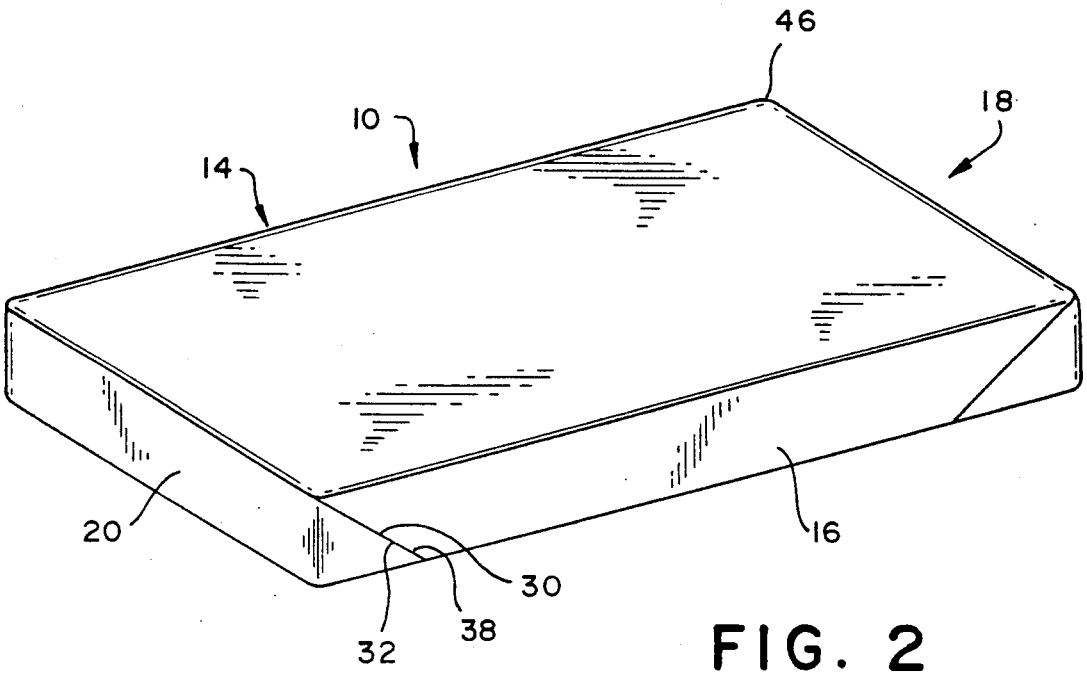
FIG. 2 is a perspective view of a preferred embodiment of the invention placed over a mattress.

The preferred embodiment will now be described with reference to FIGS. 1 through 3. The preferred embodiment, generally designated by reference numeral 10, is a mattress cover/fitted bed sheet.

Referring to FIGS. 1-A and 1-B, mattress cover or fitted bed sheet 10 is formed from a substantially rectangular blank of textile material 12. Blank 12 has opposed sides 14 and 16 and opposed ends 18 and 20. A pair of triangular pieces 22 and 24 are cut out of the opposed sides 14 and 16, respectively, adjacent end 18. A pair of triangular pieces 26 and 28 are cut out of the opposed sides 14 and 16, respectively, adjacent end 20. Each of triangular cut outs 22, 24, 26 and 28 have a pair of opposed sides 30 and 32, an apex 34 directed inwardly on the blank of textile material 12 and a base 36 coincident with one of the sides 14 or 16. Referring to FIG. 3, sides 30 and 32 of each of triangular cut outs 22, 24, 26, and 28 are joined to form biased side seams 38. The Applicant prefers that sides 30 and 32 be equal, as this provides a neater appearance. When one side is longer than another, while the same hold on the mattress is obtained, a "flap" of excess material is created which is not aesthetically pleasing.

The particular advantage provided by this mattress cover/bed sheet 10 is the manner in which, when placed on a mattress 40, excess textile material 42 (or "under wrap") is drawn under ends 18 and 20 of the mattress 40. This can be illustrated by a simple experiment using a sheet of paper. Consider the sheet of paper to be a blank of textile material 12. Cut triangular cut outs 22, 24, 26, and 28 from the paper as illustrated in FIG. 1. Tape sides 30 and 32 of the triangular cut outs together. It will be apparent from the resulting paper model the manner in which material is pulled under a mattress at ends 18 and 20.

The ability of mattress cover/fitted bed sheet 10 to cling to mattress 40 can be verified by using what is referred to in the prior art as the "cling test". With this test the mattress cover/fitted bed sheet 10 is grabbed in the middle and pulled. When this was done using a crib mattress, the cling was such that the mattress was suspended in the air by mattress cover/fitted bed sheet 10 and despite shaking maintained its cling.

There is a mathematical relationship between the amount of "under wrap" 42 and the size of triangular cut outs 22, 24, 26, and 28. The distance b along base 36 of triangular cut outs 22, 24, 26, and 28 is equal to twice the thickness of the mattress plus the desired amount of textile material or "under wrap" 42 to the drawn under ends 18 and 20 of mattress 40. Mattress cover or fitted bed sheet 10 can accommodate a variety of thicknesses of mattress. It should be noted that if the base equals twice the thickness of the mattress plus the desired amount of "underwrap" 42 it makes no difference as to whether mattress 40 is 4 inches thick with a 3 inch "under wrap" 42 at the ends 18 or 20 or 3 inches thick with a 4 inch "under wrap" 42. The distance a between base 36 and apex 34 of each of triangular cuts outs 22, 24, 26, and 28 is normally made equal to the thickness of mattress 40. However, where it is desired that textile material or "under wrap" 44 from sides 14 and 16 be drawn under mattress 40, the distance between base 36 and apex 34 is increased by the desired amount of "under wrap" 44. An embodiment of the present invention having more end "underwrap" than side "underwrap" is shown in FIGS. 2 and 3. An elastic 43 is secured between end "under wrap" 42 and side "under wrap" 44 to draw any excess textile material from sides 14 and 16 or ends 18 and 20 together under mattress 40.

Figure 3:
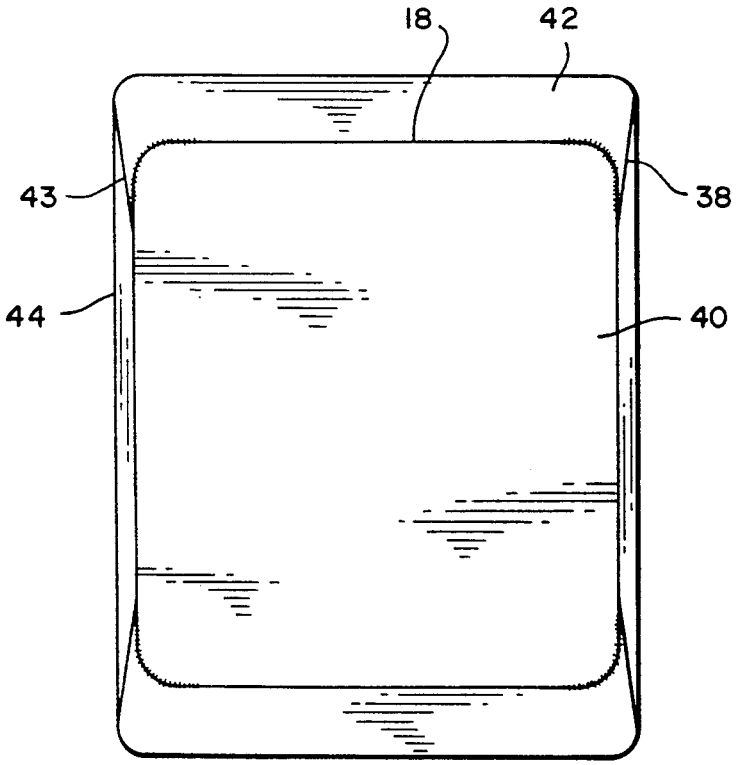
FIG. 3 is a bottom plan view of the mattress cover/fitted bed sheet illustrated in FIG. 2 showing that the end underwrap is greater than the side underwrap.

Mattresses are constructed with rounded corners, such as corner 46 illustrated in FIG. 2. In order to permit mattress cover or fitted bed sheet 10 to fit the rounded contour of corner 46, sides 30 and 32 of triangular cut outs 22, 24, 26, and 28 have arcuate end portions, as illustrated in FIG. 1-B. When sides 30 and 32 are joined to form biased side seam 38, a contoured corner is created.

The most difficult type of "mattress" to fit is the bladder used for a waterbed. The Applicant has used the preferred embodiment of mattress cover/fitted bed sheet 10 on water bladders with good "cling test" results.

The limits of the invention will now be discussed. FIG. 1-A illustrates one variation which can be made to the triangular cut out. Although the Applicant prefers to use the variation illustrated in FIG. 1-B, sides 30 and 32 of triangular cut outs 22, 24, 26, and 28 can be curvilinear as illustrated in FIG. 1-A. Other variations can be made to sides 30 and 32, by serrating the edges, etc; however, the cuts outs must be generally triangular. The Applicant prefers to place the triangular cut outs right at the ends of the rectangular blank of sheet material, as illustrated. However, the triangular cuts outs can be moved in from the ends by a few inches and still function. If the triangular cut outs are moved in from the ends a small redundant "flap" of material is created which must be either cut off or sewn in a manner not to be obtrusive. The Applicant prefers to cut out the triangular cut outs before sewing the sheet, however it will be apparent to one skilled in the art that the triangular cut out may be removed after sewing or retained as a redundant flap. If it is desired to cut the triangular cut out off after sewing the end is folded over and an angled seam is placed across the corner. When a cut is made across this angled seam, the result is a triangular cut out. Instead of "cutting out" a triangle, which is the most practical way of making the fitted bed sheet or mattress cover, one could consciously decide to follow the teachings of the invention but retain a redundant flap of triangular material. In order to anticipate this method of designing around the patent, wherever the applicant uses the words "cut out" in his claims it shall be deemed to include the retention of a redundant triangular flap on a fitted bed sheet or mattress cover which otherwise meets the limitations of the claims. This extended definition of "cut out" is intended to overcome the inherent limitation in language when attempting to protect a worthwhile invention.

It will be apparent to a person skilled in the art that the described alternate fitted bet sheet or mattress cover will fit a variety of thicknesses of mattress 40 by drawing an "under wrap" 42 under and gripping ends 18 and 20 of mattress 40. The Applicant has used the same size of the preferred embodiment to fit a variety of mattresses varying in thickness from 6 inches to 9 inches. In contrast, the mattress covers/fitted bed sheets in the prior art do not have a "universal" fit but rather can only fit one specified thickness of mattress. The universal fit is attributable to the amount end underwrap inherent to the Applicant's design. Increasing the thickness of the mattress merely reduces the amount of underwrap, the additional thickness of the mattress.

It will also be apparent to one skilled in the art that the teachings of the Applicant can be used in manufacturing a superior fitted top sheet which fits the mattress at just one end, so as to permit the user to slide between the sheets at the opposed end.

It will also be apparent to one skilled in the art that minor modifications may be made to the preferred embodiment without departing from the spirit and scope of the invention as defined in the claims.

I claim:

1. A mattress cover/fitted bed sheet, comprising:

a substantially rectangular blank of textile material with opposed sides and opposed ends, such that the sides of the sheet are longer than the ends of the sheet, having generally triangular pieces cut out of the opposed sides where the sides meet the ends, each of the generally triangular cut outs having a pair of opposed sides, an apex directed inwardly on the textile material and a base coincident with one of the sides of the textile material, the generally triangular cutouts being located such that one of the opposed sides of the cut outs substantially coincides with a side to end edge corner, the sides of the triangular cut outs being joined to form an inwardly slanting diagonal biased side seam such that, when placed on a mattress, more textile material is drawn under the end of the mattress than is drawn under the sides of the mattress, thereby attaining a fit and hold which will accommodate a plurality of thicknesses of mattress.

2. A mattress cover/fitted bed sheet, as defined in claim 1 the opposed sides of the triangular cutout being equal, the distance between the base and apex of the triangle being equal to the thickness of the mattress plus the desired amount of textile material to be drawn under the side of the mattress.

3. A mattress cover/fitted bed sheet, as defined in claim 1 the sides of the triangular cutout being curvilinear.

4. A mattress cover/bed sheet as defined in claim 1, having an elastic secured between the end and the side to draw any excess textile material under the mattress.

5. A mattress cover/bed sheet as defined in claim 1, the distance along the base of the triangle being equal to twice the thickness of the mattress plus the desired amount of textile material to be drawn under the end of the mattress.

6. A mattress cover/bed sheet as defined in claim 1, the sides of the triangular cut out having arcuate end portions at the apex such that when joined to form the inwardly slanting diagonal side seam follows the contour of the mattress corner prior to slanting inwardly in diagonal fashion.

7. A mattress cover/fitted bed sheet blank, comprising:

a sheet of textile material with opposed sides and opposed ends, such that the sides of the sheet are longer than the ends of the sheets, having generally triangular pieces cut out of the opposed sides where the sides meet the ends, each of the generally triangular cut outs having a pair of opposed sides, an apex directed inwardly on the textile material and a base coincident with one of the sides of the textile material, the generally triangular cutouts being located such that one of the opposed sides of the cut outs substantially coincides with a side to end edge corner, the sides of the triangular cut outs being joinable to form an inwardly slanting diagonal biased side seam such that, when placed on a mattress, more textile material is drawn under the end of the mattress than is drawn under the sides of the mattress, thereby attaining a fit and hold which will accommodate a plurality of thicknesses of mattress.

8. A mattress cover/fitted bed sheet blank, comprising:

a sheet of textile material with opposed sides and opposed ends, such that the sides of the sheet are longer than the ends of the sheets, having generally triangular pieces cut out of the opposed sides where the sides meet the ends, each of the generally triangular cut outs having a pair of opposed sides, an apex directed inwardly on the textile material and a base coincident with one of the sides of the textile material, the generally triangular cutouts being located such that one of the opposed sides of the cut outs coincides with a side to end edge corner, the sides of the triangular cut outs being joinable to form an inwardly slanting diagonal biased side seam such that, when placed on a mattress, more textile material is drawn under the end of the mattress than is drawn under the sides of the mattress, thereby attaining a fit and hold which will accommodate a plurality of thicknesses of mattress.

* * * * *

UNITED STATES PATENT AND TRADEMARK OFFICE

CERTIFICATE OF CORRECTION

PATENT NO. : 5,173,976
DATED : December 29, 1992
INVENTOR(S) : Gisele Jubinville It is certified that error appears in the above-indentified patent and that said Letters Patent is hereby corrected as shown below:

Title page, item [75], inventor: change "Gisele B. Jubinville" to -- Gisele Y. Jubinville--.

Signed and Sealed this

Nineteenth Day of July, 1994

*Attest:*

*Attesting Officer*

BRUCE LEHMAN

*Commissioner of Patents and Trademarks*